US005447135A

United States Patent [19]

Norkus

[11] Patent Number: 5,447,135

[45] Date of Patent: Sep. 5, 1995

[54] PNEUMATIC THROTTLE CONTROL

[75] Inventor: George E. Norkus, Marine City, Mich.

[73] Assignee: The United States of America as represented by the Secretary of the Army, Washington, D.C.

[21] Appl. No.: 268,905

[22] Filed: Jun. 28, 1994

[51] Int. Cl.[6] ..... F02D 7/00

[52] U.S. Cl. ..... 123/401

[58] Field of Search ..... 123/401, 395, 319, 360, 123/339; 180/176, 197

[56] References Cited

U.S. PATENT DOCUMENTS

| | | | |
|---|---|---|---|
| 4,220,218 | 9/1980 | Riddel | 180/176 |
| 4,465,045 | 8/1984 | Bollinger et al. | 123/360 |
| 4,962,823 | 10/1990 | Luft et al. | 180/197 |
| 4,991,552 | 2/1991 | Luft et al. | 123/401 |
| 5,014,667 | 5/1991 | Meyer | 123/360 |
| 5,052,507 | 10/1991 | Luft et al. | 180/197 |
| 5,065,719 | 11/1991 | Panten et al. | 123/339 |

*Primary Examiner*—Raymond A. Nelli

*Attorney, Agent, or Firm*—Peter A. Taucher; Gail S. Soderling

[57] ABSTRACT

The present invention is a hand operated throttle control system for use with a fuel flow control mounted on an internal combustion engine. A hand piece assembly mounted on the vehicle rotated has an actuator so rotation of the hand piece causes a corresponding rotation of the housing. The actuator has a hydraulic structure which uses the rotation of the hand piece to cause a corresponding hydraulic pressure to cause fuel control modification.

1 Claim, 1 Drawing Sheet

PNEUMATIC THROTTLE CONTROL

GOVERNMENT INTEREST

The invention described herein may be manufactured, used and licensed by or for the Government for governmental purposes without payment to me of any royalty.

BACKGROUND OF THE INVENTION

1. Field of the Invention

In one aspect this invention relates to fuel controls. In yet a further aspect, this invention relates to hand controls for use on fuel powered vehicles.

2. Prior Art

Many small gasoline powered vehicles have hand controls for the fuel supply. Such systems frequently involve the use of cables and other mechanical linkages. The linkages are subject to breakage and wear because they are exposed to the elements and abuse. It would be desirable to have a control device which would not have moving parts which are exposed to road contamination. In addition it would be desirable to have a linkage which could be installed and conform to a vehicle even if the installation required the linkage to make the type of sharp bends impossible with mechanical parts.

BRIEF SUMMARY OF THE INVENTION

Briefly, the present invention discloses a hand operated throttle control system for use on vehicles in combination with a gasoline flow control mounted on an internal combustion engine. The throttle control has a hand piece assembly mounted on a post attached to the vehicle so the hand piece is accessible to the driver. The hand piece will have a handle for gripping which can be rotated.

An actuator housing is attached to the hand piece so that rotation of the hand piece causes a corresponding rotation of the housing. A fixed projection extends radially outward from the surface of the post into the housing's interior creating a constriction zone.

The flow control has a hydraulic line with a flexible, compressible midsection disposed about the post as a loop. The loop is contained within the housing and the projection on the post contacts and constricts a portion of the flexible midsection so rotation of the actuator causes fluid flow in the hydraulic line.

A flow control actuator is mounted near the fuel flow control. The actuator has a housing and a control piston reciprocatingly mounted within the housing, the control piston having an activation arm extending outward from the housing and being attached to the flow control. The piston divides the interior of the housing into first and second fluid chambers.

One end of the hydraulic line is fluidly connected to the first chamber and the other end of the line is fluidly connected to the second chamber so as to form a closed fluidic loop. Because the fluid loop is a closed system, rotation of the handle causes the constriction zone to move and a consequent flow of fluid within system moving the activation arm.

DETAILED DESCRIPTION OF PREFERRED EMBODIMENTS

Figure 1:
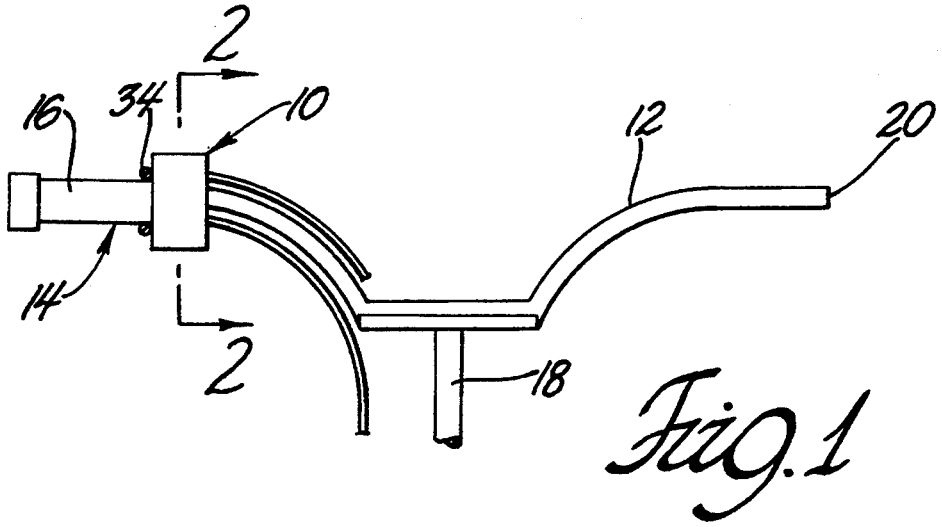
FIG. 1 Is a partial view of one embodiment of this invention mounted on a handle bar structure.
Figure 2:
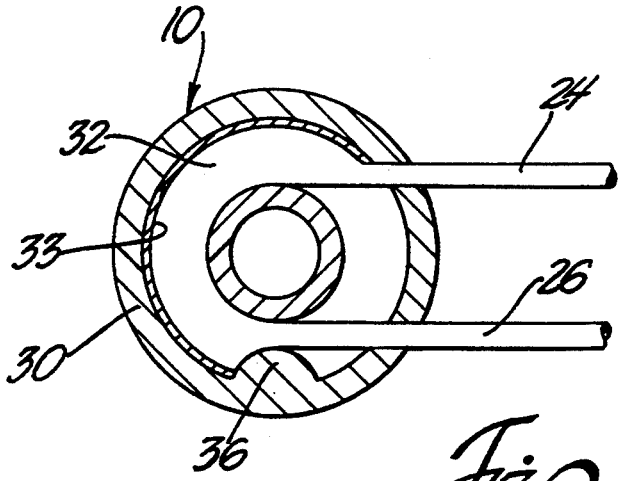
FIG. 2 Is a view in section of an actuator housing of FIG. 1.

Referring to the accompanying drawing, where like numerals refer to like pans, and initially to FIG. 1, a hand operated throttle control system for use on vehicles according to this invention is designated generally 10 and is shown mounted on a set of handle bars 12. The throttle control system 10 will be described as installed on handle bar directed vehicle i.e., a moped, all terrain vehicle or the like. Although the present description is directed to a vehicle steered by means of handle bars, the control mechanism is amenable to use on other types of vehicles with other steering means.

As is common with vehicles of this configuration, the handle bars 12 have a hand piece assembly 14 which comprises a hand grip 16 mounted on each end the handle bars 12 at a location where the hand grips can be easily grasped by a driver. The hand grip 16 can be thought of as rotatably mounted on a post or other similar mounting means. One end of the handle bar 12 is attached to the vehicle's steering column 18 and has a second free end 20 extending outward from the steering column. The hand grip 16 is mounted on the handle bar 12 near the free end 20 so the hand grip can be rotated about the hand grip's longitudinal axis. The mounting means is not shown as such mounting means are known in the art and the exact structure is not part of this invention.

The throttle control system 10 has a flexible hydraulic line 33 with first and second hydraulic control ends 24, 26 extending therefrom the ends being in fluid communication with the interior of the throttle control assembly 10 as will be described later and also the fuel control device.

The throttle control actuator 10 shown is formed with a toroidal housing 30 coaxially disposed about the handle bar 12 and enclosing a toroidal shaped chamber 32 within the toroidal housing. The toroidal housing 30 interfaces with the hand grip 16 at a complimentary portion 34 of the hand grip so that rotation of the hand grip by the driver causes a corresponding rotation of the toroidal housing. A fixed projection 36 extends radially inward from the toroidal housing's interior surface into the toroidal chamber 32. The fixed projection 36 creates a constricted area in the chamber 32 which is associated with the flexible hydraulic line.

The flexible hydraulic line 33 has an easily deformable midsection 33, easily compressed by the projection 36, which is disposed about the handle bar 12 and constrained within the toroidal chamber 32. The first end 24 and second end 26 extend out of the toroidal housing 30 and to the fuel control 28. The deformable midsection 33, essentially fills the chamber 32 of actuator 10 with the projection 36 contacting and compressing and constricting a portion of the flexible midsection 33. Because the flexible hydraulic line is completely filled with a hydraulic liquid, rotation of the toroidal housing 30 causes the projection 36 to move and causes a corresponding movement of the reduced cross sectional area of the flexible midsection 33. This causes a reduced hydraulic fluid pressure on one side of the projection and an increased fluid hydraulic pressure on the other side of the projection. The resulting pressure differential causes a corresponding movement of the flow control.

Figure 3:
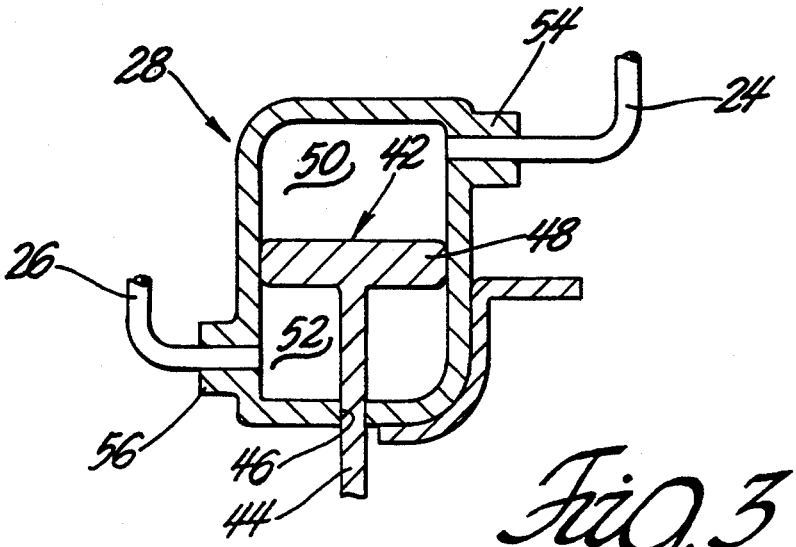
FIG. 3 Is a sectional view of a flow control actuator according to this invention.

Referring to FIG. 3., The flow control actuator generally 28 is attached to a fuel control means such as a carburetor not shown. The actuator 28 has a housing 40 the housing having a control piston 42 reciprocatingly mounted within the housing. The control piston 42 has an activation arm 44 extending outward from the housing 40 through an aperture 46 formed in one end of the housing. The activation arm 44 is mechanically attached to the fuel flow control to move the flow control incrementally to the desired fuel flow so as to control engine speed. The piston head 48 divides the interior of the housing into first and second fluid chambers 50, 52 respectively.

A first fluid attachment means 54 on the housing 40 is attached to the first end 24 of the hydraulic line and a second fluid attachment means 56 on the housing is attached to the second end 26 of the hydraulic line so as to form a closed fluidic loop.

Because the hydraulic system is a closed loop a rotation of the handgrip causing the compressed area to rotate creates a sufficient pressure differential in the hydraulic system to move the activation arm.

Various modifications and alterations will become apparent to those skilled in the art with out departing from the scope and spirit of this invention and it is understood that this invention is not limited to the illustrative embodiments set forth above.

What is claimed is:

1. A hand operated throttle control system for use on vehicles in combination with a fuel flow control mounted on an internal combustion engine, the throttle control being used to control the engine speed comprising:

a hand piece assembly mounted on a post having a first end attached to the vehicle at a location accessible to a driver, the hand piece assembly having a handle suitable for gripping by the driver mounted on the other end of the post, the hand piece being rotatable about its longitudinal axis;

an actuator attached to a complimentary portion of the hand piece the actuator including a housing being coaxially disposed about the post so that rotation of the hand piece causes a corresponding rotation of the housing, and the post having a fixed projection extending radially outward from the surface of the post, the projection intruding into the housing interior;

a hydraulic line having first and second ends, the midsection of the hydraulic line being formed with a flexible, compressible portion, the flexible midsection being disposed about the post as a loop, the loop of compressible material being contained within the housing, the projection on the post being in contact with and constricting a portion of the flexible midsection;

a flow control actuator attached to the gasoline flow control, the actuator having a housing with first and second fluid chambers therein the housing having a first fluid attachment means mounted on the housing and in fluid communication with the first fluid chamber, the first fluid attachment means being attached to the first end of the hydraulic line and having a second fluid attachment means mounted on the housing and in fluid communication with the second fluid chamber, the second fluid attachment means being attached to the second end of the hydraulic line so as to form a closed fluidic loop, the housing having a control piston reciprocatingly mounted within the housing, the control piston having an activation arm extending outward from the housing through an aperture formed in one end, the activation arm being mechanically attached to the gasoline control device to move the flow control to the desired fuel flow, the piston dividing the interior of the housing into first and second fluid chambers;

whereby, a rotation of the handle causes a flow of fluid within the closed fluidic loop which in turn causes a movement of the activation arm.

* * * * *